US007426955B2

(12) United States Patent
Kimura et al.

(10) Patent No.: US 7,426,955 B2
(45) Date of Patent: Sep. 23, 2008

(54) CORE STRUCTURE OF HEAT EXCHANGER

(75) Inventors: Satoshi Kimura, Tokyo (JP); Katsumi Nakamura, Tokyo (JP); Shiro Nakajima, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 607 days.

(21) Appl. No.: 11/050,439

(22) Filed: Feb. 4, 2005

(65) Prior Publication Data

US 2005/0199379 A1 Sep. 15, 2005

(30) Foreign Application Priority Data

Feb. 4, 2004 (JP) ..... 2004-028476

(51) Int. Cl.
*F28F 9/013* (2006.01)

(52) U.S. Cl. ..... 165/76; 165/906

(58) Field of Classification Search ..... 165/76, 165/178, 906
See application file for complete search history.

(56) References Cited

U.S. PATENT DOCUMENTS 1,847,743 A * 3/1932 Anderson ..... 165/76
2,258,041 A * 10/1941 Young ..... 403/202
4,351,390 A * 9/1982 Argyle et al. ..... 165/149
4,396,059 A * 8/1983 Banner et al. ..... 165/134.1
4,754,538 A * 7/1988 Stewart et al. ..... 29/890.031
4,862,714 A 9/1989 Taylor et al.
6,006,430 A * 12/1999 Fukuoka et al. ..... 29/890.03
6,938,675 B2 * 9/2005 Kokubunji et al. ..... 165/11.1

FOREIGN PATENT DOCUMENTS

JP 2-54076 A 2/1990
JP 11-14285 A 1/1999

* cited by examiner

*Primary Examiner*—Allen J Flanigan
(74) *Attorney, Agent, or Firm*—Foley & Lardner LLP

(57) ABSTRACT

A core structure of a heat exchanger includes seat plates arranged opposite to each other with a predetermined space interposed between them and formed with tube holes, reinforcements connecting the seat plates at their end portions, tubes fixed at its both end portions by insertion into the tube holes, corrugated fins arranged between the tubes, and an upper and lower tanks attached to the seat plates. The tanks are connected by the tubes so that coolant flows between the tanks through the tubes. Tubes arranged at outermost positions of a core part among the tubes are inserted at its end portions by insert members so that the insert members can increase rigidity of the end positions of the outermost positioned tubes and ensure flowing of the coolant between the tanks through the outermost positioned tubes.

8 Claims, 6 Drawing Sheets

CORE STRUCTURE OF HEAT EXCHANGER

BACKGROUND OF THE INVENTION

1. Field of the Invention

The present invention relates to a core structure of a heat exchanger that includes tubes and corrugated fins arranged alternatively between the seat plates connected by reinforcements.

2. Description of the Related Art

A core structure of a heat exchanger of this kind is disclosed in Japanese patent laying-open publication No. (Hei) 11-14285. This core structure of the heat exchanger is constructed so that tubes and corrugated fins are alternately arranged between seat plates and both edge portions are coupled and reinforced by reinforcements.

Further, another conventional core structure of a heat exchanger is disclosed in Japanese utility model laying-open publication No. (Hei) 02-54076. This core structure of the heat structure is used for hybrid electric vehicles or the like, and has the core structure similar to the above conventional one, while it has two tanks attached to seat plates and two core parts for cooling coolants with different temperature or different kind of coolant.

The above known conventional core structures of the heat exchanger, however, encounter a problem that edge portions, especially contacting portions with the seat plates, of the tubes have a tendency to be cracked due to rapid changes in temperature from low to high of the coolant flowing through the tubes.

Ordinarily, the rapid changes in temperature hardly occurs, while rapid change of coolant flowing an engine into a radiator in temperature from low to high occurs, for example, in a case that when the engine is started in a cold region, coolant of the engine increases gradually in temperature but does not flow into the radiator until it reaches a valve-opening temperature of a thermostat, and then the temperature of the coolant becomes high to cause a valve of the thermostat to open, so that the coolant of high temperature flows into the radiator for the first time, or in a case of hunting phenomena such that the thermostat repeats opening and closing. This results in repeated change of thermal expansion and construction in longitudinal and thickness directions of the tubes. In this case, the tubes arranged at the outermost positions of the seat plates are restricted in their thermal expansions in the thickness direction by the reinforcements, thermal stresses due to the differences between the thermal expansion amounts of the tubes, the reinforcements, and the seat plates concentrate on seat-plate contacting portions of the outermost positioned tubes to cause the contacting portions to crack.

Incidentally, the heat exchanger used in a hybrid electric vehicle or the like has the tubes that are arranged at outermost positions of the two core parts, and especially adjacent tubes of the core parts are applied by strong thermal stress to be cracked because of coolants with different temperatures flowing in the tubes.

In order to avoid the above problem, there is a case that dummy tubes sealed at their end portions are used at the outermost positions of seat plates, which brings the heat changer degradation of heat exchanging performance and enlargement of its dimensions.

It is, therefore, an object of the present invention to provide a core structure of a heat exchanger which overcomes the foregoing drawbacks and can avoid occurrence of a crack in a seat-plate contacting portion of a tube arranged at an outermost position of the seat plate without degradation of heat exchanging performance and enlargement of dimensions of a heat exchanger.

SUMMARY OF THE INVENTION

According to a first aspect of the present invention there is provided a core structure of a heat exchanger including seat plates, reinforcements, tubes, corrugated fins and upper and lower tanks. The seat plates are arranged opposite to each other with a predetermined space interposed therebetween, and they are formed with tube holes. The reinforcements connect the seat plates at end portions thereof. The tubes are fixed at both end portions thereof by insertion into the tube holes, and the corrugated fins are arranged between the tubes. The upper and lower tanks are attached to the seat plates, and they are connected by the tubes so that coolant can flow between the tanks through the tubes, where the tubes and the corrugated fins are alternatively arranged to form a core part, and a tube, which is arranged in at least an outermost position of the core part among the tubes, is inserted at end portions thereof by insert members so that the insert members increase rigidity of the end positions of the tube inserted by the inset members and ensure flowing of the coolant between the tanks through the tube inserted by the insert members. The insert members include two insert portions to be inserted in the tube and a connecting portion that connects the insert portions with each other in a state that a space formed between the insert portions can flow the coolant between an inside of the tube and an inside of the tank through the space when the insert member is inserted in the tube. The connecting portion is positioned out of the tube, and the insert portions being bent toward an edge side of the seat plate so that the connecting portion is dislocated from an overhead of opening of the tube.

Therefore, the insert members are inserted in the edge portions of the tube and increase rigidity of the tube, so that a crack is not caused in the tube even when thermal stress concentrates on a seat-plate contacting portion of the tube due to rapidly repeated changes of the coolant temperature, resulting in an improvement in durability of the core structure of the heat exchanger. In addition, the insert members ensure the flowing between the tanks through the tube even when the insert members are inserted in the tube, which can avoid degradation of heat exchanging performance and enlargement of dimensions of a heat exchanger. In addition, the insert portions coupled by the connecting portion can reinforce the tube from its inside to increase its rigidity, ensuring the avoidance of an occurrence of a crack in the tube with a simple structure and low manufacturing cost. Further, the coolant can pass through the insert members while the lowering of its current speed is suppressed at a low level, resulting in maintaining the heat exchanging performance.

Preferably, the connecting portion has an opening to pass the coolant.

Therefore, the coolant can pass also through the opening, improving the flow through the insert members.

Preferably, the insert portions have a stopper portion to determine an insert length of the insert portions in the tube by contact of the stopper portion and the tube.

Therefore, the insert members can be inserted in the tube and easily stopped at its proper position.

Preferably, the tube include tubes adjacent to each other that belong to adjacent different core parts of the heat exchanger and are arranged in at least adjacent outermost positions of the core parts.

Therefore, the similar advantages listed above can be obtained when a core structure of a heat exchanger that has two adjacent core parts where coolants in different temperatures flows is used in a hybrid electric vehicle or the like.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
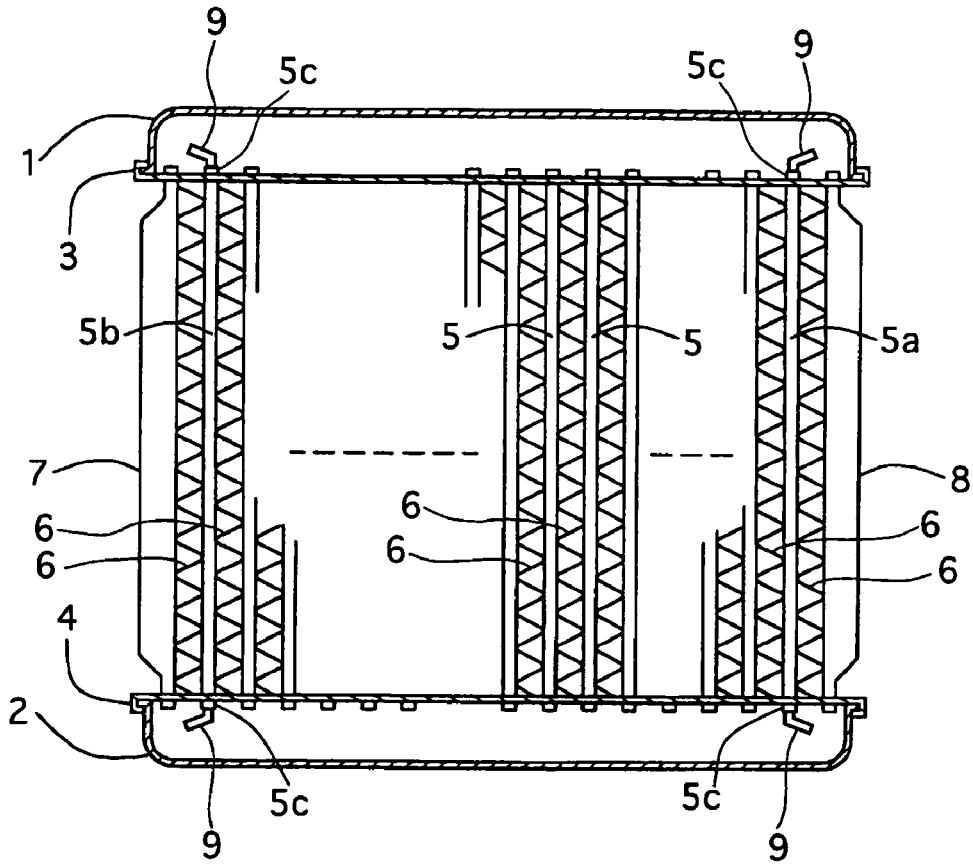
FIG. 1 is a front view partly in section showing a core structure of a heat exchanger according to a first embodiment of the present invention.

Throughout the following detailed description, similar reference characters and numbers refer to similar elements in all figures of the drawings, and their descriptions are omitted for eliminating duplication.

Figure 2:
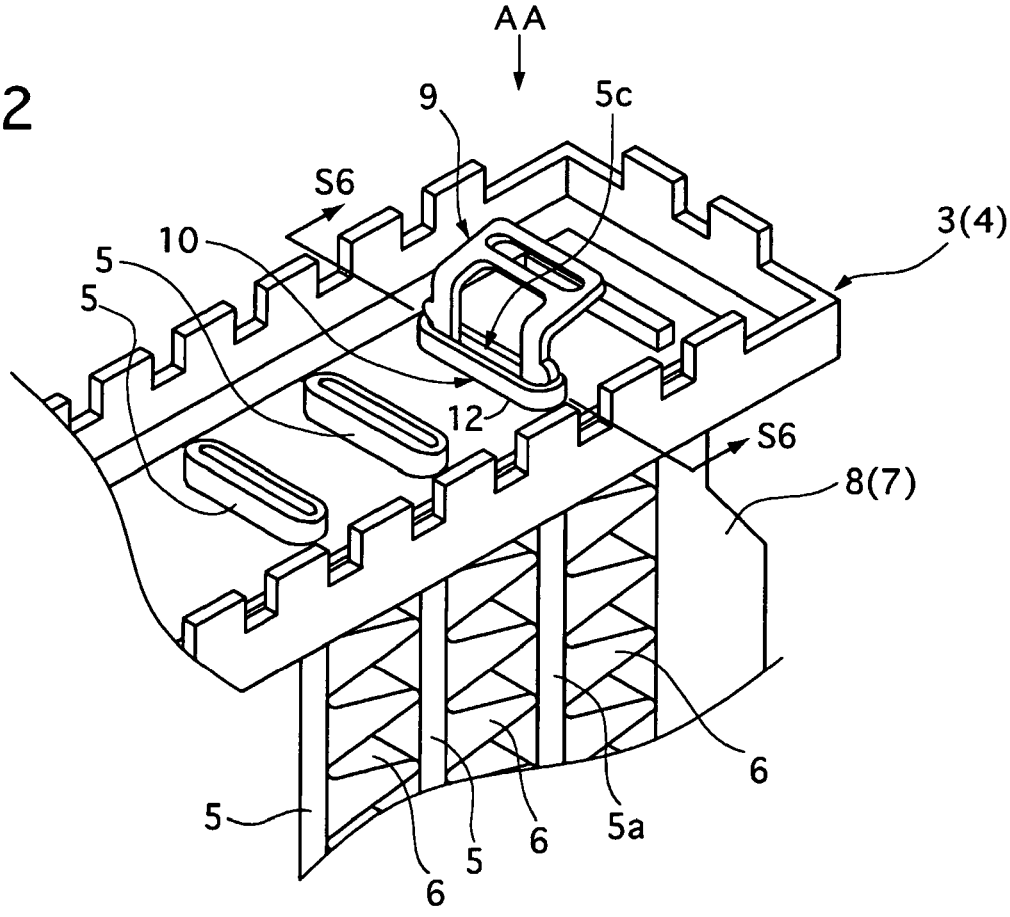
FIG. 2 is an enlarged segmentary and perspective view showing an upper portion of an upper seat plate in an upper tank, which are used in the core structure shown in FIG. 1.

Referring to FIGS. 1 and 2 of the drawings, there is shown a first preferred embodiment of a core structure of a heat exchanger according to the present invention. FIG. 1 shows an entire front view partly in section of the core structure of the heat exchanger, and FIG. 2 shows an upper portion of an upper seat plate in an upper tank, which are used in the core structure shown in FIG. 1.

The core structure includes an upper and lower seat plates 3 and 4, a pair of tanks 1 and 2 attached to the seat plates 3 and 4 respectively, reinforcements connecting the seat plates 3 and 4, tubes 5, 5*a*, and 5*b*, and corrugated fins 6.

The upper seat plate 3 and the lower seat plate 4 have plural tube holes 12 to fix the tubes 5, 5*a*, and 5*b* by insertion of the tubes 5, 5*a*, and 5*b* in the tube holes 12. The upper and lower seat plates 3 and 4 are connected by the reinforcements 7 and 8 at their end portions, respectively.

The tubes 5, 5*a*, and 5*b* and the corrugated fins 6 are alternatively arranged between the reinforcements 7 and 8 to form a core part. The tubes 5, 5*a*, and 5*b* have holes to flow coolant from the upper tank 1 to the lower tank 2, and tubes 5*a* and 5*b* arranged at outermost positions of the core part are inserted by insert members 9, which will be described in detail later.

In this core structure of the first embodiment, the seat plates 3 and 4, the tubes 5, 5*a*, and 5*b*, the corrugated fins 6, reinforcements 7 and 7, and the insert members 9 are made of aluminum, and assembled in advance and then brazed in a heat treatment furnace, not shown.

After the blazing, the upper and lower tanks 1 and 2, made of resin, are attached to the upper and lower seat plates 3 and 4, respectively, while the core part and the tanks 1 and 2 are brazed in a heat treatment furnace when the tanks 1 and 2 are made of aluminum.

Figure 4:
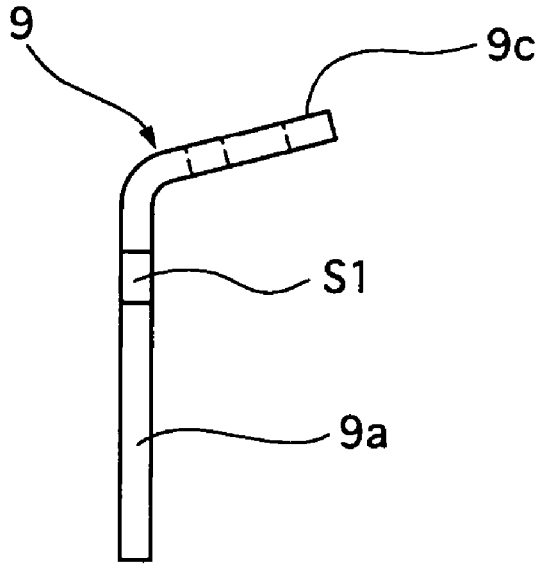
FIG. 4 is a side view of the insert member shown in FIG. 3.
Figure 5:
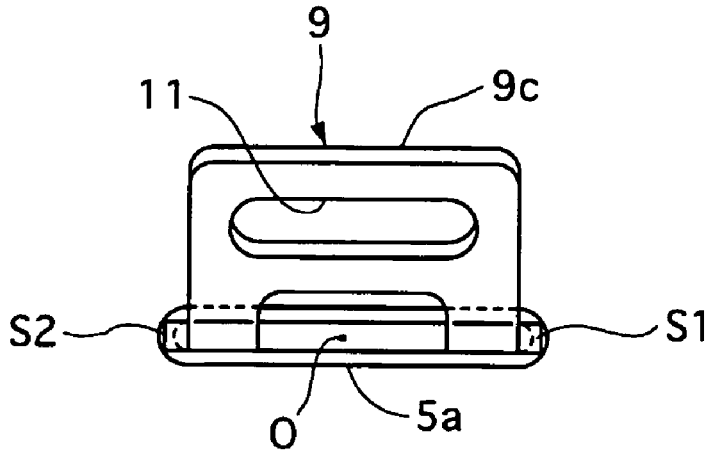
FIG. 5 is a plain view of the insert member inserted the tube, which is shown from the overhead of the tube as indicated by an arrow AA of FIG. 2.
Figure 6:
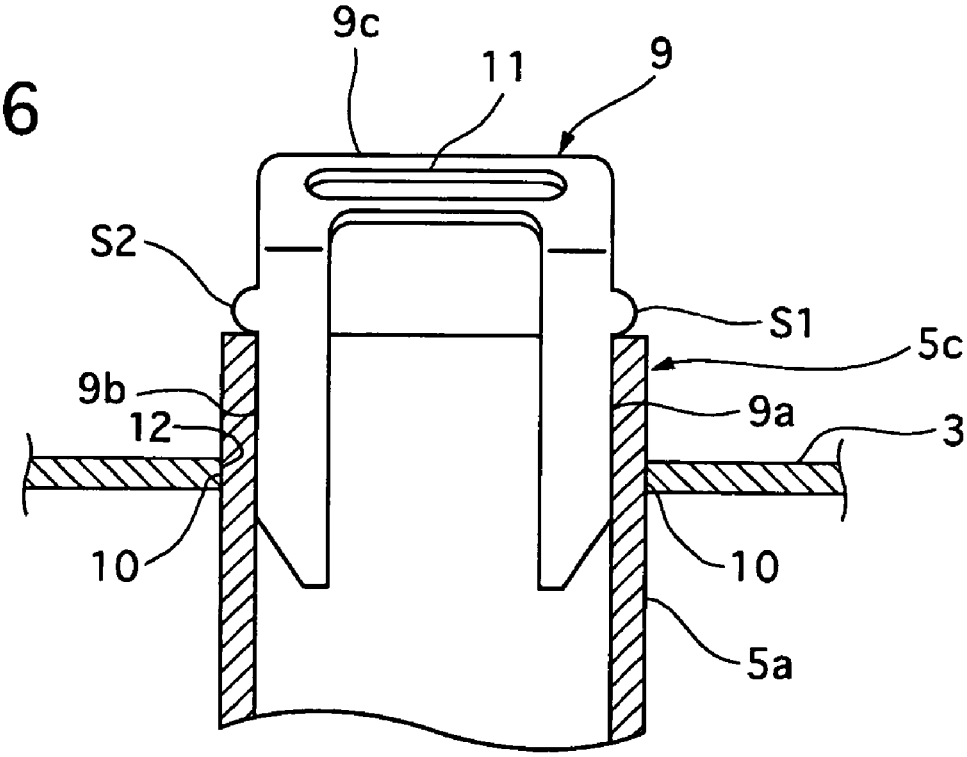
FIG. 6 is a cross sectional view of the insert member and the tube, taken along by the line S6-S6 of FIG. 2.
Figure 7A:
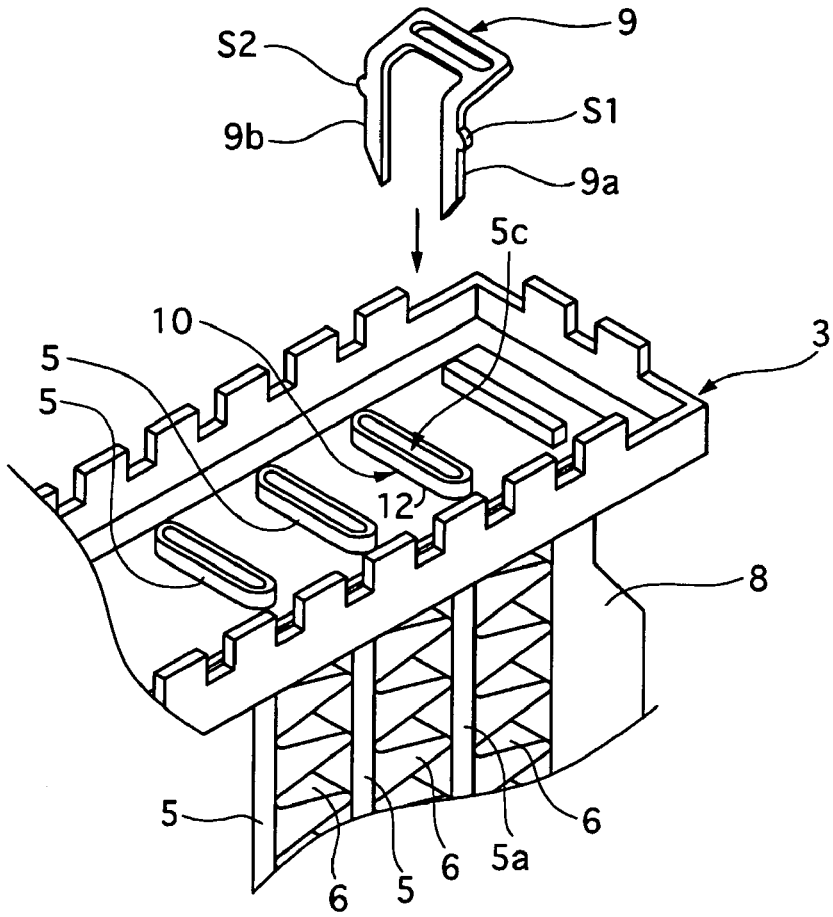
FIG. 7A is a perspective view showing the upper portion of the upper seat plate before the insert member is inserted in the tube.
Figure 7B:
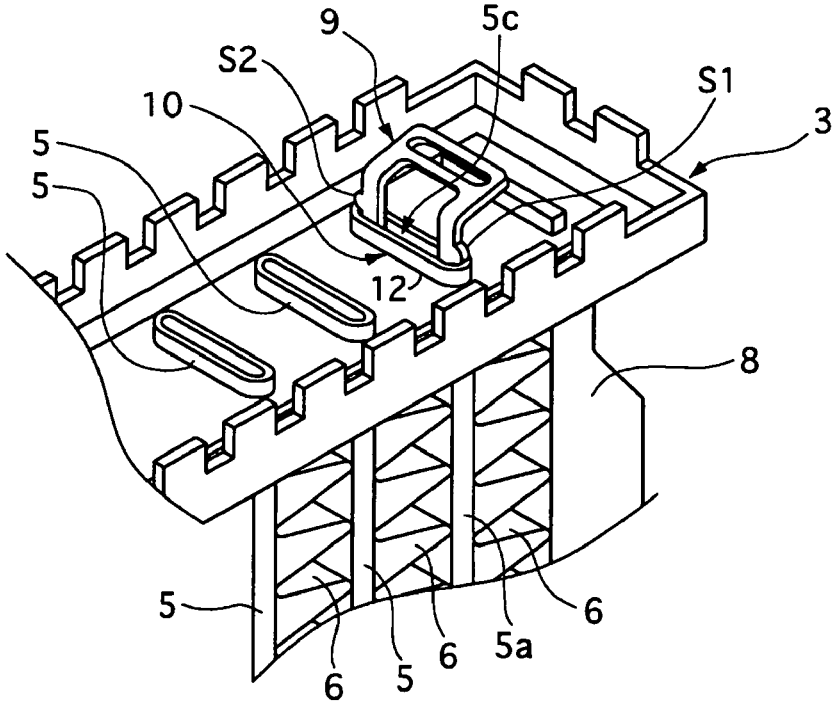
FIG. 7B is a perspective view showing the upper portion of the upper seat plate after the insert member is inserted in the tube.

As shown in FIGS. 3 to 6, the insert members 9 are formed to have two insert portions 9*a* and 9*b*, and a connecting portion 9*c* that connects the insert portions 9*a* and 9*b* at their end portions. Note that the insert portions 9*a* and 9*b* are set in length to extend deeper than the positions of seat-plate contacting portion 10 of the tube 5*a* as shown in FIG. 6 when the insert members 9 are inserted in the tubes 5*a* and 5*b*. FIG. 7A shows a state of the insert members 9 and tube 5*a* before the insertion, and FIG. 7B shows a state of them after the insertion.

The insert portions 9*a* and 9*b* are insertable in the holes of the tubes 5, 5*a*, and 5*b* to contact with an inner side of the hole, and are formed to have a tapered shape at their inserting edge portions for easy inserting. The insert portions 9*a* and 9*b* are provided with topper portions S1 and S2 to contact with the edge portions 5*c* of the tube 5, 5*a*, and 5*b* and determine an insert length in the hole.

Figure 3:
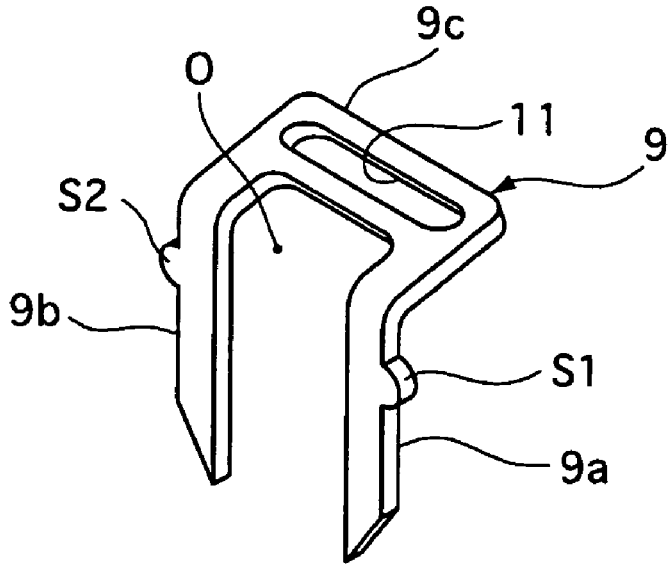
FIG. 3 is an enlarged perspective view of an insert member to be inserted in a tube shown in FIGS. 1 and 2.

The insert portions 9*a* and 9*b* are bent at their intermediate portions, as shown especially in FIGS. 3 and 4, so that a space O through which the coolant can flow is formed between the insert portions 9*a* and 9*b* as shown in FIGS. 3 and 5 and so that the connecting portion 9*c* is dislocated from the overhead of the hole of tube 5*a* or 5*b* as shown in FIG. 5. The connecting portion 9*c* is formed with an opening 11 to pass the coolant, which improves the flow of the coolant in the tanks 1 and 2.

The insert members 9 can be assembled by either a manual procedure with using clipping tool of the connecting portions 9*c* or an automatic assembly machine.

The core structure of the heat exchanger of the first embodiment has the following advantages.

The inset members 9 have insert portions 9*a* and 9*b* inserted in the holes of the edge portions 5*c* of the outermost positioned tubes 5*a* and 5*b*, which increases the rigidity of the tubes 5*a* and 5*b*, especially at their seat-plate contacting portions 10. Accordingly, the occurrence of a crack in the tubes 5*a* and 5*b* can be avoided even when the thermal stress concentrates on the seat-plate contacting portions 10 of the tubes 5*a* and 5*b* due to the rapidly repeated change of the coolant in temperature. This improves the durability of the tubes 5*a* and 5*b*, and then the heat exchanger. The tubes 5*a* and 5*b* inserted by the insert members 9 can flow the coolant between the tanks 1 and 2 through the tubes 5*a* and 5*b*, which avoids degradation of the heat exchanging performance and the enlargement of dimensions of the heat exchanger.

The space O formed between the insert portions 9*a* and 9*b*, bending the insert portions 9*a* and 9*b* to dislocate the connecting portion 9*c* from the overhead of the holes of the tubes 5*a* and 5*c*, and the opening 11 formed in the connecting portion 9*c* can flow the coolant smoothly between the tanks 1 and 2 through the tubes 5*a* and 5*b*, reducing a flow resistance to suppress the lowering of the current speed of the coolant.

Figure 8:
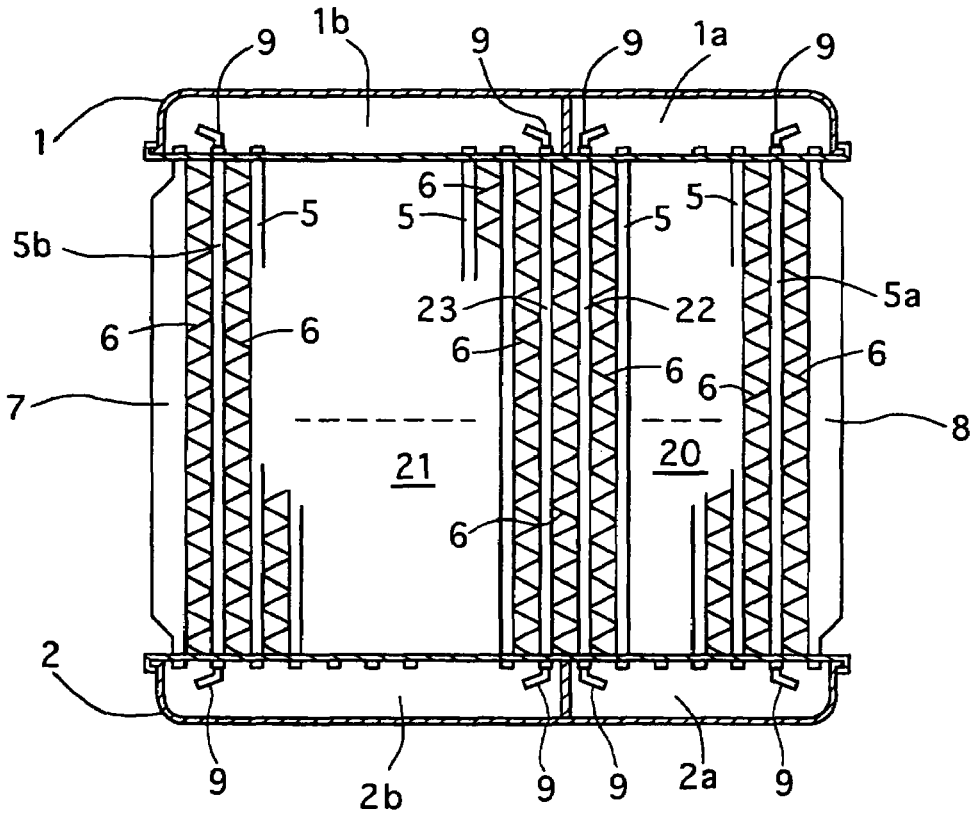
FIG. 8 is a front view partly in section showing a core structure of a heat exchanger according to a second embodiment of the present invention.

A core structure of a heat exchanger according to a second embodiment of the present embodiment will be described with reference to the accompanying drawing of FIG. 8.

In this embodiment, the core structure of the heat exchanger is used for a hybrid electric vehicle or the like. Inner spaces of an upper and lower tanks 1 and 2 are divided into two chambers 1*a* and 1*b*, and 2*a* and 2*b*, respectively, and accordingly the core structure has two core parts 20 and 21 adjacent to each other. The two cores 20 and 21 are connected to the two chambers 1*a* and 2*a*, and 1*b* and 2*b* of the tanks 1 and 2 respectively so as to flow coolants in different temperatures. Tubes 22 and 23 arranged adjacently to each other and at adjacent outermost positions of the core parts 20 and 21 are inserted by insert members 9 having the structure similar to those of the first embodiment. Accordingly, in this embodiment, outermost positioned tubes of the present invention include the tubes 22 and 23 that are arranged at the adjacent outermost positions of the core parts 20 and 21 arranged adjacently to each other to flow the coolants in different temperature, in addition to reinforce 7 and 8 side outermost positioned tubes 5*b* and 5*a*.

The core structure of the heat exchanger of the second embodiment can be used for a core structure having adjacent different core parts of a heat exchanger for a hybrid electric vehicle or the like, and has the advantages similar to those of the first embodiment.

While there have been particularly shown and described with reference to preferred embodiments thereof, it will be understood that various modifications may be made therein, and it is intended to cover in the appended claims all such modifications as fall within the true spirit and scope of the invention.

The entire contents of Japanese Patent Application No. 2004-028476 filed Feb. 4, 2004 is incorporated herein by reference.

What is claimed is:

1. A core structure of a heat exchanger comprising:

seat plates arranged opposite to each other with a predetermined space interposed therebetween, said seat plates being formed with tube holes;

reinforcements connecting said seat plates at end portions thereof;

tubes fixed at both end portions thereof by insertion into the tube holes;

corrugated fins arranged between said tubes; and an upper tank and a lower tank attached to said seat plates, said tanks being connected by said tubes so that coolant can flow between said tanks through said tubes, wherein said tubes and said corrugated fins are alternatively arranged to form a core part, and a tube, which is arranged in at least an outermost position of said core part among said tube, being inserted at end portions thereof by insert members so that the insert members increase rigidity of the end positions of said tube inserted by the insert members and ensure flowing of the coolant between the tanks through said tube inserted by the insert members, wherein the insert members include two insert portions to be inserted in said tube and a connecting portion that connects the insert portions with each other in a state that a space formed between the insert portions can flow the coolant between an inside of said tube and an inside of said tank through the space when the insert member is inserted in said tube, and wherein the connecting portion is positioned out of said tube, and the insert portions being bent toward an edge side of the seat plate so that the connecting portion is dislocated from an overhead of an opening of said tube.

2. The core structure of the heat exchanger according to claim 1, wherein the connecting portion has an opening to pass the coolant.

3. The core structure of the heat exchanger according to claim 1, wherein the insert portions have a stopper portion to determine an insert length of the insert portions in said tube by contact of the stopper portion and said tube.

4. The core structure of the heat exchanger according to claim 3, wherein the connecting portion has an opening to pass the coolant.

5. The core structure of the heat exchanger according to claim 1, wherein said tube includes tubes adjacent to each other that belong to adjacent different core parts of the heat exchanger and are arranged in at least adjacent outermost positions of the core parts.

6. The core structure of the heat exchanger according to claim 4, wherein said tube includes tubes adjacent to each other that belong to adjacent different core parts of the heat exchanger and are arranged in at least adjacent outermost positions of the core parts.

7. The core structure of the heat exchanger according to claim 5, wherein the connecting portion has an opening to pass the coolant.

8. The core structure of the heat exchanger according to claim 3, wherein said tube includes tubes adjacent to each other that belong to adjacent different core parts of the heat exchanger and are arranged in at least adjacent outermost positions of the core parts.

* * * * *